US005713510A

United States Patent [19]

Walton

[11] Patent Number: 5,713,510

[45] Date of Patent: Feb. 3, 1998

[54] CONTAINERS

[75] Inventor: David Walton, Bishop Auckland, Great Britain

[73] Assignee: Walton Industrial Containers Ltd., County Durham, England

[21] Appl. No.: 617,871

[22] PCT Filed: Apr. 26, 1995

[86] PCT No.: PCT/GB95/00950

§ 371 Date: Sep. 16, 1996

§ 102(e) Date: Sep. 16, 1996

[87] PCT Pub. No.: WO95/29851

PCT Pub. Date: Nov. 9, 1995

[30] Foreign Application Priority Data

Apr. 29, 1994 [GB] United Kingdom ..... 9408640

[51] Int. Cl.[6] ..... B65D 5/465

[52] U.S. Cl. ..... 229/117.11; 229/117.24; 229/117.25; 220/754

[58] Field of Search ..... 229/117.11, 117.24, 229/117.25; 220/754

[56] References Cited

U.S. PATENT DOCUMENTS 1,245,479 11/1917 Lundy ..... 229/117.11
3,563,433 2/1971 Yoshiura ..... 229/117.11
3,750,869 8/1973 Kartiganer ..... 229/117.11
3,913,827 10/1975 Bruckner ..... 229/117.11
5,570,834 11/1996 Larson et al. ..... 229/117.11

FOREIGN PATENT DOCUMENTS 0062964 10/1982 European Pat. Off. .
0093059 11/1983 European Pat. Off. .

*Primary Examiner*—Joseph M. Moy
*Attorney, Agent, or Firm*—Larson & Taylor

[57] ABSTRACT

A collapsible container (C) primarily for transporting liquid, powdered or granular material is of polygonal transverse section and includes a plurality of rigid sidewalls (2, 4, 6, 8) interconnected by flexible hinges (16), each sidewall (2, 4, 6, 8) having a top flap (26, 28, 30, 32) and a bottom flap (18, 20, 22, 24) interconnected therewith by flexible hinges (48, 40). At least one, and preferably two, straps (56, 58) are threaded through the upper and lower hinges (48, 40) and through the container to provide external support across the base of the assembled container, and such as not to interfere with the collapsibility of the container, lifting means (60) being provided at the ends of the or each strap (56, 58).

6 Claims, 3 Drawing Sheets

CONTAINERS

TECHNICAL FIELD

This invention relates to containers, and more particularly to containers for the bulk transportation of liquids, powders and granules.

BACKGROUND ART

It is well-established practice to transport liquid and other relatively dense materials in cylindrical drums which may be of, for example, steel or rigid plastics.

However, the use of such containers can result in a number of problems.

The containers are usually supported on associated pallets for transportation purposes, these pallets generally being of rectangular configuration. Thus it will be appreciated that usage of the available rectangular surface area of the pallets cannot be maximised by containers of circular cross-section supported thereon.

Additionally, the containers must be transported to a filling station prior to filling thereof, and, once emptied, must be returned to the filling station for subsequent use. The bulky nature of the drums makes their transportation in their empty condition relatively uneconomical and expensive, while their disposal at the end of their useful lifetime is difficult—the material of such containers is environmentally unfriendly.

It has been proposed to use collapsible rectangular containers to transport liquids, powders and granules with a view to overcoming the aforementioned disadvantages of the drums.

Containers of this type commonly comprise four rigid sidewalls interconnected with one another by flexible hinges extending the length of the sidewalls, each sidewall having an associated top and bottom flap similarly hinged thereto. Typically the sidewalls are of plywood and the hinges are of a flexible plastics material such as coated woven polypropylene, such a construction being environmentally friendly for disposal purposes.

The containers are usually provided with plastic liners to hold the contents being transported thereby, and the dimensions of the containers can be chosen in proportion to those of the associated pallets whereby, for example, the cross-sectional area of a container is equal to one quarter that of the pallet—so a pallet can carry four containers with no wasted space thereon.

The containers can be collapsed into perfectly flat form—the top flaps and bottom flaps are first of all folded into the container, and the body of the container is then collapsed with two adjacent sidewalls lying on top of the other two oppositely adjacent sidewalls by virtue of the flexible nature of the hinges therebetween.

Thus it will be appreciated that the transportation of the empty containers is extremely economical. Conveniently the dimensions of the sidewalls of a container are such that the length thereof is substantially equal to the length of a pallet, and the width thereof is substantially equal to half the width of the pallet, with the result that the area of the collapsed pallet is substantially equal to the surface area of the pallets, and transportation of the collapsed containers is particularly convenient and economical.

When assembling collapsible containers for filling and subsequent transportation, it is necessary to ensure that the base of the container, defined by the four bottom flaps, is securely fastened to prevent any possible bursting thereof that might occur as a result of the weight of material therein on suspension of the container. Such securing, which may be achieved by, for example stapling of the flaps, is a time-consuming exercise, while the fastening must be released to enable flat-packing of the container for transportation to the filling station.

DISCLOSURE OF THE INVENTION

It would be desirable to be able to provide a collapsible container capable of transporting material therein without the necessity for any permanent fastening means being secured to the bottom flaps of the container, and such as to allow the containers, when empty, to be readily collapsed.

According to the present invention there is provided a container of polygonal transverse section and including a plurality of rigid sidewalls adjacent ones of which are interconnected with one another by flexible hinges extending the lengths thereof, each sidewall having associated therewith an upper flap and a lower flap each interconnected with the sidewall by a flexible hinge extending therebetween, characterised in that the container further includes at least one strap extending from externally of the container through the flexible hinge between a top flap and the associated sidewall, downwardly and inwardly of said sidewall, through the flexible hinge between said sidewall and the associated bottom flap, across the base of the container externally of the container, through the flexible hinge between an opposite sidewall and its associated bottom flap, upwardly and inwardly of said opposite sidewall, and through the flexible hinge between said opposite sidewall and its associated top flap, and lifting means at or adjacent the ends of the or each strap.

It will be appreciated that, with such an arrangement, and on assembly of the container, the bottom flaps are folded to overlie one another with the bottom flap with which the strap is associated lowermost, whereby, on suspension of the container by the lifting means, the strap extending across the base of the container effectively supports the bottom flaps and the contents of the container.

In a preferred embodiment of the invention, the container is of rectangular transverse section and includes two straps both extending downwardly and inwardly of a first sidewall and upwardly and inwardly of the opposite sidewall, one to each side of the upright centrelines of said sidewalls.

Conveniently each bottom flap is of a width equal to that of the associated sidewall, and of a depth substantially equal to half the width of the adjacent sidewall,the bottom flaps of the first sidewall and the opposite sidewall underlying the bottom flaps of the adjacent sidewalls, whereby both of said straps extend across and below the bottom flaps of both the first sidewall and the opposite sidewall.

Preferably the sidewalls of the container each comprise a rigid panel, for example of plywood, encased in a flexible material, for example woven polypropylene, the hinges between adjacent sidewalls being defined by said flexible material between adjacent side edges of said sidewalls.

Similarly, the top and bottom flaps may each comprise a rigid panel, for example of plywood, encased in a flexible material, for example woven polypropylene, the hinges between the top and bottom flaps and the associated sidewalls being defined by said flexible material between adjacent edges of the flaps and the sidewalls.

In a preferred container, the lifting means comprise loops one at each end of the or each strap.

DESCRIPTION OF THE PREFERRED EMBODIMENT

Figure 1:
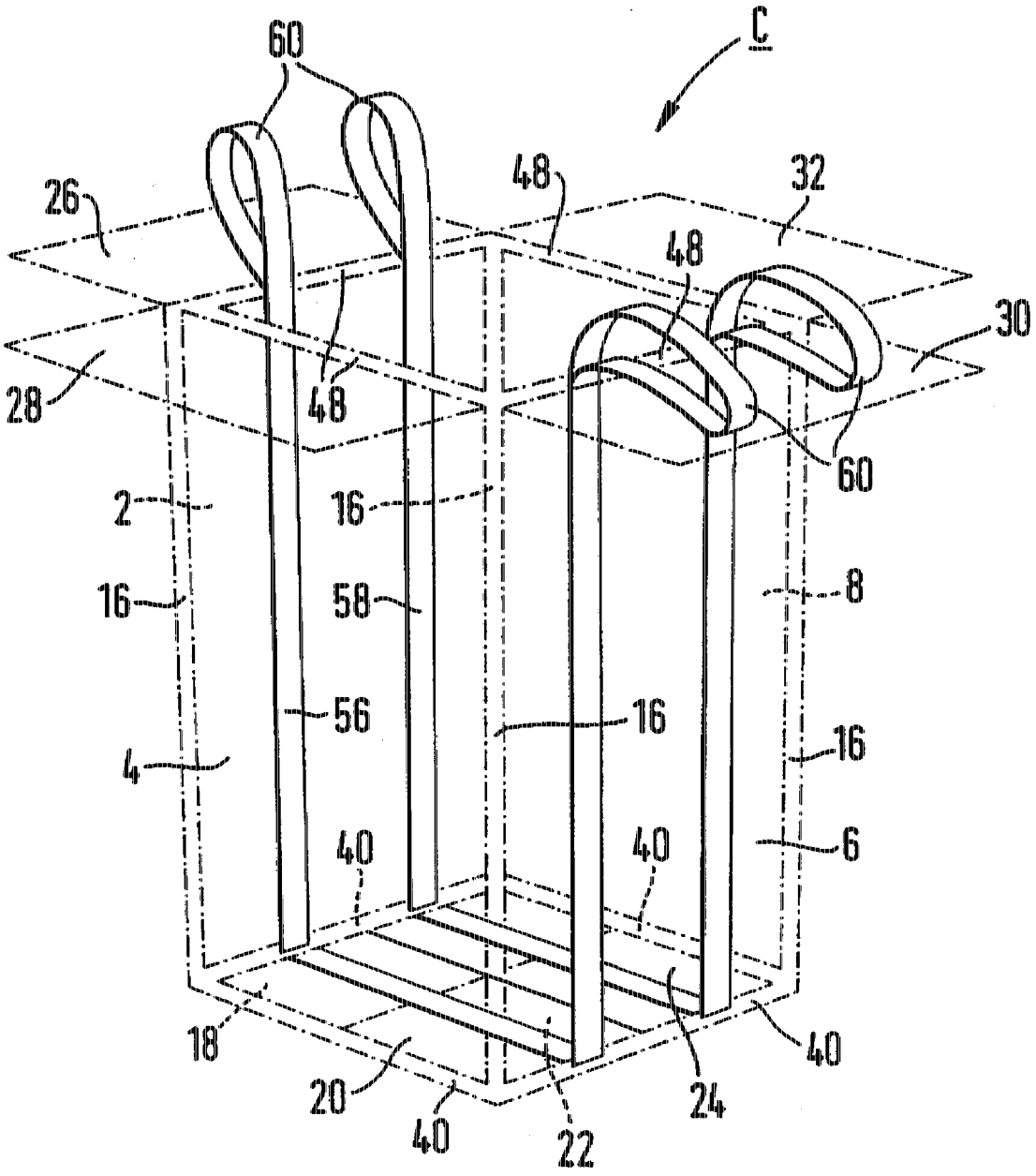
FIG. 1 is a schematic isometric view of a container according to the invention provided with two straps.
Figure 2:
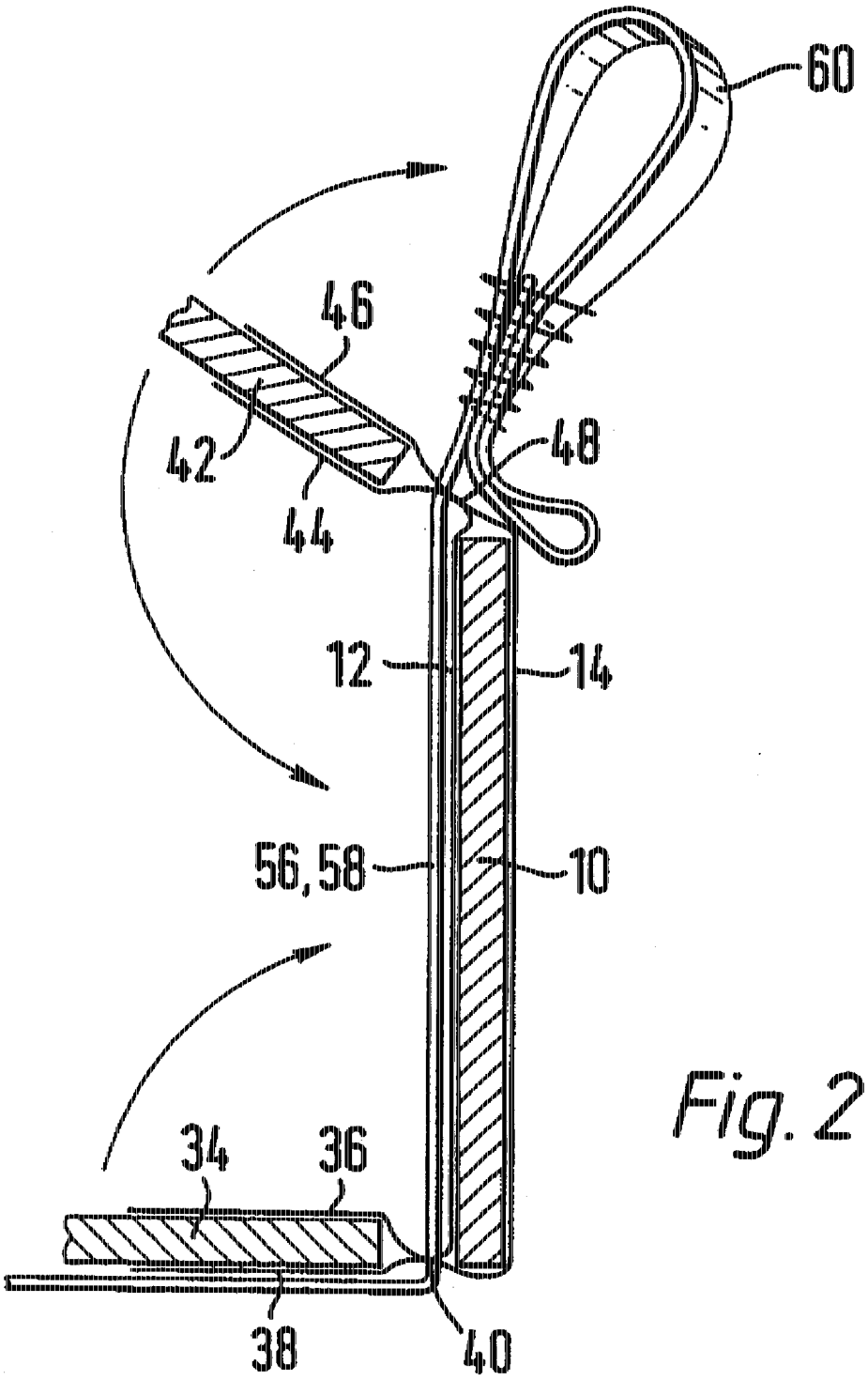
FIG. 2 is a vertical section through part of a container according to the invention.

Referring to FIGS. 1 and 2, the illustrated container, generally referenced C, is of rectangular transverse section and includes four rectangular sidewalls 2,4,6,8 each comprising a rigid panel 10 of, for example, birch plywood housed within an envelope of a flexible plastics material such as woven polypropylene.

The envelopes each comprise inner and outer layers 12,14 the material of which is continuous about the full periphery of the container C, the layers being adhered together at the corners of the container between the side edges of adjacent panels 10 to define four upright hinges 16 each the length of the sidewalls at the corners of the container C.

The container C further comprises four bottom flaps 18,20,22,24 associated with the sidewalls 2,4,6,8 respectively, and four top flaps 26,28,30,32 associated with the sidewalls 2,4,6,8 respectively.

Each top and bottom flap is of a width equal to that of the associated sidewall, and is of a depth substantially equal to half the width of the adjacent sidewalls for reasons which will become apparent.

More particularly, each bottom flap 18,20,22,24 comprises a rigid panel 34 of, for example, birch plywood housed within an envelope of a flexible plastics material, such as woven polypropylene, having inner and outer layers 36,38 which are continuations of the inner and outer layers 12,14 respectively. The inner and outer layers 36,38 are adhered together between the adjacent edges of the panels 10,34 to define flexible hinges 40 between the sidewalls and the bottom flaps.

Similarly each top flap is of a width equal to that of the associated sidewall and of a depth substantially equal to half the width of the adjacent sidewalls, and is of a construction the same as that of the bottom flaps—the rigid panel of the top flap is referenced 42, the inner and outer layers of flexible plastics material (being continuations of the layers 12,14) are referenced 44,46 respectively, and the flexible hinges between the top flaps and the sidewalls are referenced 48.

Figure 3:
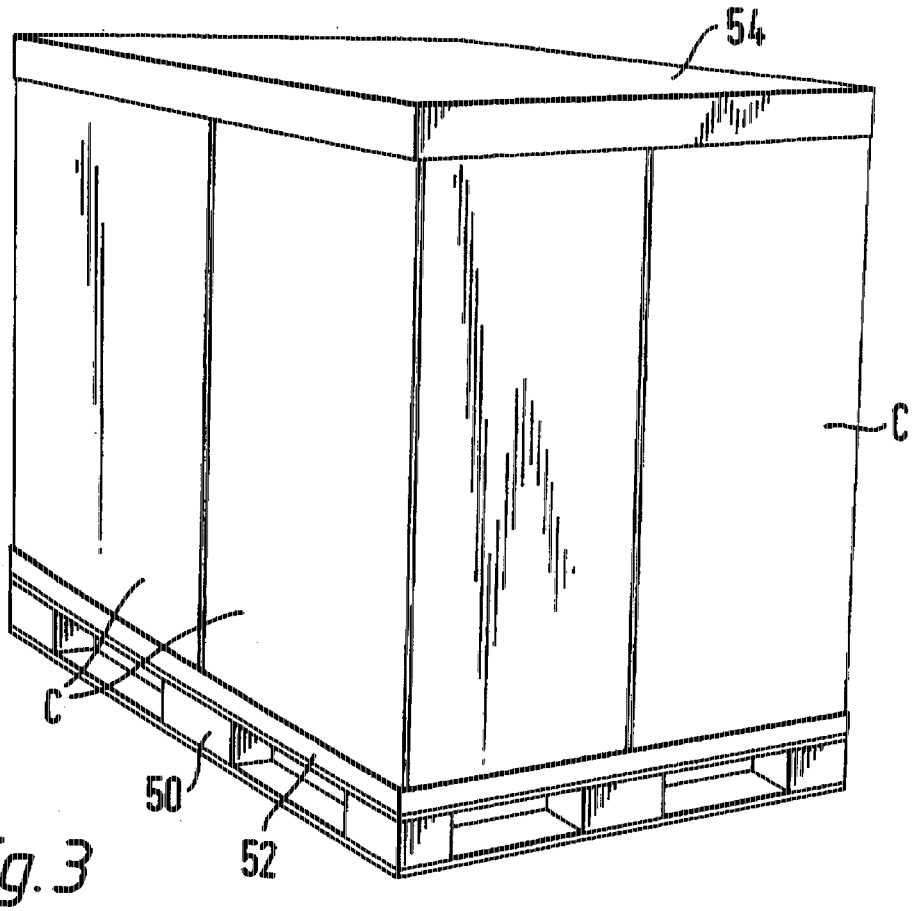
FIG. 3 shows four assembled containers according to the invention on an associated pallet.

The container so far described is of relatively conventional form, and is of an assembled size such that the transverse sections of four filled containers as shown in FIG. 3 equate to the surface area of a conventional pallet 50, whereby said containers can be transported on said pallet 50 without any wasted space thereon. The pallet 50 includes an upstanding retaining edged 52 therearound, while a lid 54 covers the tops of the containers during transportation.

Figure 4:
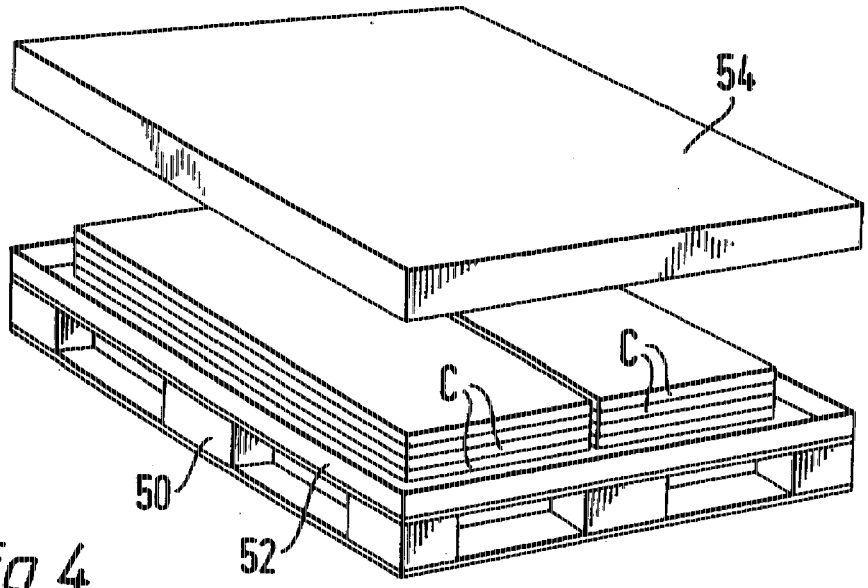
FIG. 4 shows the containers of FIG. 3 in their collapsed conditions on the pallet.

The containers C can each be collapsed by folding the bottom flaps up into the container about the hinges 40, folding the top flaps down into the container about the hinges 48, and collapsing the sidewalls about two opposed hinges 16 such that two adjacent sidewalls are superimposed on the other two adjacent sidewalls as shown in FIG. 4. The dimensions of the collapsed containers are substantially equal to that of the surface of the pallet 50 whereby a plurality of stacked collapsed containers can be transported effectively and efficiently on a pallet 50. The lid 54 can be fitted over the collapsed containers on the pallet 50 to enable further flat-packed units to be stacked on top thereof.

It will be appreciated that unsupported filled containers as described can only be suspended or otherwise transported without bottom support if the bottom flaps 18 to 24 are securely fastened together to prevent spilling out of the contents of the container through the bottom thereof.

Referring back to FIGS. 1 and 2, such fastening is achieved by means of two straps 56,58 each of a flexible, non-extensible material such as polypropylene/nylon. More particularly, each strap 56,58 extends through the hinge 48 between the top flap 26 and the sidewall 2, downwardly and inwardly of the sidewall 2, through the hinge 40 between the sidewall 2 and the bottom flap 18, across the base of the container outwardly of the bottom flaps, through the hinge 40 between the bottom flap 22 and the sidewall 6, upwardly and inwardly of the sidewall 6, and through the hinge 48 between the sidewall 6 and the top flap 30.

Each strap 56,58 is provided with loops 60 on the ends thereof, the straps 56,58 being spaced apart from one another one to each side of the vertical centrelines of the sidewalls 2,6.

When assembling the described container, and with the bottom flaps 18 to 24 located inwardly of the associated sidewalls 2 to 8, the bottom flaps 18,22 associated with sidewalls 2, 6 are first of all folded into positions defining an outer base to the container, and the bottom flaps 20,24 are then folded downwardly onto said flaps 18,22 to complete the base. The flaps 18 and 22 overlap each other slightly, as do the flaps 20,24.

The straps 56,58 extending across the base of the container do not interfere with formation of the base, and it will be appreciated that the straps 56,58 each extend across the full depth of both the bottom flaps 18,22 to provide support thereto without the necessity for any permanent fixings of or to the bottom flaps.

Assembly of the container C is completed by folding the flaps 26,28,30,32 to form a top to the container—an anti-theft device may be provided on said top flaps to indicate unauthorised opening of the container if desired.

Thus, on lifting of the filled container C onto or from a pallet by means of the loops 60, for example using the tines of a fork lift truck each passing through two of said loops 60, the straps 56,58 extending across the bottom of the container prevent any collapsing of the bottom of the container.

The straps 56,58 are threaded through the container in such a way that they do not interfere with the assembly or collapsibility of the empty container, displacement of the straps 56,58 relative to the container being prevented by the presence of the loops 60 which are unable to pass through the narrow slits provided in the hinges 48 for the passage therethrough of the straps 56,58 themselves.

Clearly the number of straps provided can be chosen to suit particular requirements, while the container may have other than four sidewalls without departing from the scope of the invention.

The container may be used to transport liquids, powders, granules or the like and will preferably be provided with a suitable liner dependent upon the material within the container.

Thus there is provided a container capable of transporting material without the necessity for effecting any permanent fastening of the bottom flaps thereof, and such that an empty container, after use, can be readily collapsed without having to dismantle or otherwise release fastening means from the base thereof.

I claim:

1. A container of polygonal transverse section and including a plurality of rigid sidewalls (2,4,6,8) adjacent ones of which are interconnected with one another by flexible hinges (16) extending the lengths thereof, each sidewall (2,4,6,8) having associated therewith an upper flap (26,28,30,32) and a lower flap (18,20,22,24) each interconnected with the sidewall (2,4,6,8) by a flexible hinge (48,40) extending therebetween, characterised in that the container further includes at least one strap (56,58) extending from externally of the container through the flexible hinge (48) between a top flap (26) and the associated sidewall (2), downwardly and inwardly of said sidewall (2), through the flexible hinge (40) between said sidewall (2) and the associated bottom flap (18), across the base of the container externally of the container, through the flexible hinge (40) between an opposite sidewall (6) and its associated bottom flap (22), upwardly and inwardly of said opposite sidewall (6), and through the flexible hinge (48) between said opposite sidewall (6) and its associated top flap (30), and lifting means (60) at or adjacent the ends of the or each strap (56,58).

2. A container as claimed in claim 1 and of rectangular transverse section, the container including two straps (56,58) both extending downwardly and inwardly of a first sidewall (2) and upwardly and inwardly of the opposite sidewall (6), one to each side of the upright centrelines of said sidewalls (2,6).

3. A container as claimed in claim 2 in which each bottom flap (18,20,22,24) is of a width equal to that of the associated sidewall (2,4,6,8) and of a depth substantially equal to half the width of the adjacent sidewalls, the bottom flaps (18,22) of the first sidewall (2) and the opposite sidewall (6) underlying the bottom flaps (20,24) of the adjacent sidewalls (4,8), whereby both of said straps (56,58) extend across and below the bottom flaps (18,22) of both the first sidewall (2) and the opposite sidewall (6).

4. A container as claimed in claim 1 in which the sidewalls (2,4,6,8) of the container each comprise a rigid panel (10) encased in a flexible material (12,14), the hinges (16) between adjacent sidewalls (2,4,6,8) being defined by said flexible material between adjacent side edges of said sidewalls (2,4,6,8).

5. A container as claimed in claim 4 in which the top flaps (26,28,30,32) and the bottom flaps (18,20,22,24) each comprise a rigid panel (42,34) encased in a flexible material (44,46,36,38), the hinges (48) between the top flaps (26,28,30,32) and the associated sidewalls (2,4,6,8), and the hinges (40) between the bottom flaps (18,20,22,24) and the associated sidewalls (2,4,6,8) being defined by said flexible material between adjacent edges of the flaps and the sidewalls.

6. A container as claimed in claim 1 in which the lifting means comprise loops (60) one at each end of the or each strap (56,58).

* * * * *